United States Patent [19]

Langer nee Layher

[11] Patent Number: 5,046,879

[45] Date of Patent: Sep. 10, 1991

[54] PERFORATED CONNECTING DISK FOR SCAFFOLDING ELEMENTS

[76] Inventor: Ruth Langer nee Layher, IM Weinberg 13, D-7129, Gueglingen (Baden-Wuettermberg), Fed. Rep. of Germany

[21] Appl. No.: 498,540

[22] Filed: Mar. 26, 1990

[30] Foreign Application Priority Data

Mar. 24, 1989 [DE] Fed. Rep. of Germany ..... 3909809

[51] Int. Cl.[5] ..... E04G 7/00

[52] U.S. Cl. ..... 403/49; 182/179

[58] Field of Search ..... 403/49; 182/179

[56] References Cited

U.S. PATENT DOCUMENTS 4,044,523 8/1977 Layher .
4,493,578 1/1985 D'Alessio .
4,867,274 9/1989 Langer .

FOREIGN PATENT DOCUMENTS 2553456 4/1985 France .

*Primary Examiner*—Andrew V. Kundrat
*Attorney, Agent, or Firm*—Antonelli, Terry, Stout & Kraus

[57] ABSTRACT

A scaffolding arrangement including a perforated disk having a central bore for accommodating an upright scaffolding element. The perforated conencting disk includes a plurality of alternately arranged large and small wedge accommodating holes, with the small wedge accommodating holes having a wedge contact surface forming a continuous curve which is symmetrical with respect to a radius which passes through a middle of the wedge contact surface of the respective small wedge holes.

8 Claims, 1 Drawing Sheet

PERFORATED CONNECTING DISK FOR SCAFFOLDING ELEMENTS

BACKGROUND OF THE INVENTION

The present invention relates to a scaffolding arrangement and, more particularly, to a perforated connecting disk for scaffolding elements, with the perforated connecting disk being adapted to be fastened on vertical scaffolding elements such as, for example, upright elements, bracing elements, intermediate parts, and/or other special elements, and with the perforated connecting disk enabling the connection of wedge-shaped tapering connecting heads with push-through wedges.

Perforated connecting disks provided with wedge holes of different sizes such as, for example, alternately large and small wedge holes have proven effective for some fifteen years in scaffolding arrangements and, in the perforated connecting disks, a smaller of the wedge holes generally has a contact area at an outer circumference thereof which is flat and vertical in an installation position, with the contact area or surface being wider than a thickness of the wedge only by an amount of play required for the installation, and with the remaining limits of the contact area being convex.

High strength perforated disks are required for connecting devices of scaffolding elements and, for this purpose, on each of the outer edges of the holes, a wedge contact surface is formed against which the wedge abuts, while an inner edge of the wedge hole plays no role in exact positioning. For a well-aligned assembly, it is especially advantageous to precisely angularly limit the contact area of at least a few wedge connections.

For this purpose, in, for example, DE PS 24 49 124 corresponding to U.S. Pat. No. 4,044,523, a scaffolding arrangement is proposed wherein a ring flange is provided with spaced cutout which are substantially oval in configuration and are so arranged that the longitudinal planes of symmetry intersect one another in the longitudinal axis. The cutouts are provided with blunt ends bounded by planar faces, with the planar faces being arcuately curved on an arc whose center coincides with the longitudinal axis. The faces can also be curved in an axial direction of the ring flange so as to obtain a particular advantageous engagement with the wedge member. The dimensions of the faces in the tangential direction correspond to the dimensions of the wedge member to be inserted so as to assure a proper seating of a free end of the respective bracing element against the respective vertical or upright element.

Recently the demand has increased for lighter scaffolding primarily in the case of rapid assembly for use by workmen and, especially in industrial applications such as, for example, when scaffolding must be inserted into interiors of boilers, scrubbing and decontamination equipment, and the like in a short period of time and through relatively small openings. In view of this demand it has been found that scaffolding elements can be made of a relatively light metal. Standardized scaffolding is restricted to certain compulsory dimensions for all of the elements that are mutually interchangeable and, for this reason, the acceptable loads are often sharply restricted by the properties of the material and the specified dimensions.

The areas around the wedge holes generally constitute areas where forces are applied and transferred and such areas are employed to optimize the stress forces and working loads.

In, for example, DE-OS 37 02 057 and corresponding U.S. Pat. No. 4,867,274, a light metal scaffolding is proposed; however, in this proposed scaffolding, conventional hole shapes are utilized and the proposed arrangement attempts to take advantage of play during installation and assembly as well as certain tolerances within a possible range. However, no deliberate effort is made to influence the stress patterns in the perforated disks.

U.S. Pat. No. 4,493,578, also proposes a scaffolding connector and system wherein brackets in the form of locking rings are provided with the brackets including a plurality of cutouts each having a bearing surface disposed at a common maximum radius so that a connector can be effectively mounted in any one of the cutouts and be functional with respect thereto. An inner circular arc defines an opposite face of each of the cutouts and is preferably disposed at the same minimum radius or at least a sufficiently small radius to prevent the bearing surface of an accommodated wedge from engaging that surface when in an operative position.

In, for example, French Published Application 2,553,456, a scaffolding arrangement is proposed which includes a ring having a plurality of radial arms disposed at 90 degree intervals with each of the arms having a radial cutout triangular in shape and having a rounded vertex and base. Lateral contact surfaces are disposed above and below the base of each of the radial arms, with the lateral contact surfaces being separated by a radial incurvation designed to serve as a locking support for front faces of branches of a connecting plate.

The aim underlying the present invention essentially resides in providing a perforated disk arrangement for scaffolding which avoids, by simple means, shortcomings and disadvantages encountered in the prior art and which enables a propagation and transfer of forces and stress patterns in a predetermined manner thereby increasing an acceptable level of stress forces and working loads for the scaffolding.

In accordance with advantageous features of the present invention, a perforated connecting disk for scaffolding is provided wherein entire hole limits of the small wedge accommodating holes, with the exception wedge contact surfaces, form a continuous curve with no discontinuities, which is symmetrical with respect to a radius passing through a center of the wedge contact surface.

While conventional perforated connecting disks were provided with a plurality of holes for accommodating the wedges, the holes were made with sharp edges even in areas near the upright elements since it was desired to guide the wedges by means of the edges of the respective holes; however, after a considerable length of time and contrary to previous assumptions, it was discovered that by improving the shape of hole edge in an area near the disk at points where the cross sections are the thinnest and by avoiding sharp corners, a significant improvement can be realized which is significant for light metal construction if a non-discontinuous shape is selected for the edge of the hole.

Thus, in accordance with the present invention, the entire hole limits of the small wedge holes, with the exception of the contact surface form a continuous curve which is symmetrical with respect to the radius passing through the middle of the wedge contact surface.

A curved shape of the hole boundary of the small wedge holes may, in accordance with the present invention, be approximately oval shaped markedly tapering at one end thereby resulting in small wedge holes being approximately of a pear-shape, with an inner area which is nearly cylindrical and faces the center, which area makes a continuous transition to side areas with a larger radii.

Depending upon the constructional features of the edge areas and direction of forces in the perforated connecting disk and transfer to the upright element, it is also possible to provide a slightly modified construction in which the wedge contact surface remains in the form provided and the remaining line pattern remains continuous and non-discontinuous.

The above and other objects, features, and advantages of the present invention will become more apparent from the following description when taken in connection with the accompanying drawing which shows, for the purpose of illustration only, one embodiment in accordance with the present invention.

DETAILED DESCRIPTION

Figure 2:
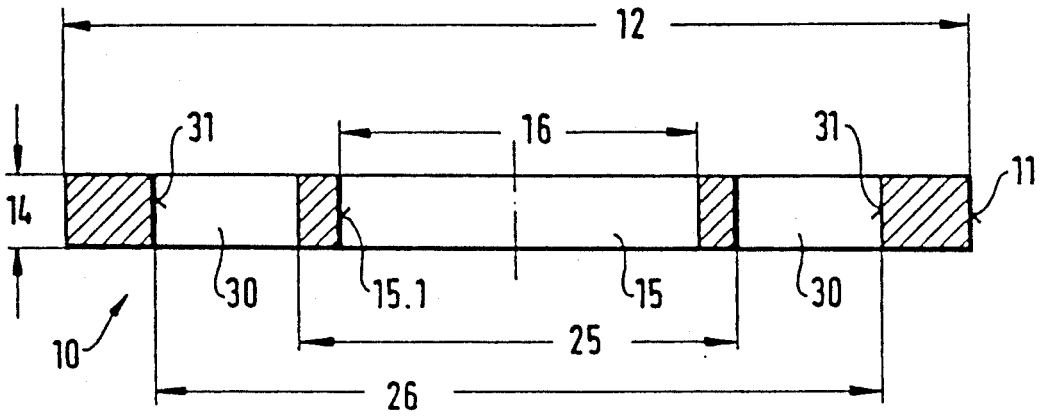
FIG. 2 is a vertical cross-sectional view taken along the line II—II in FIG. 1.
Figure 1:
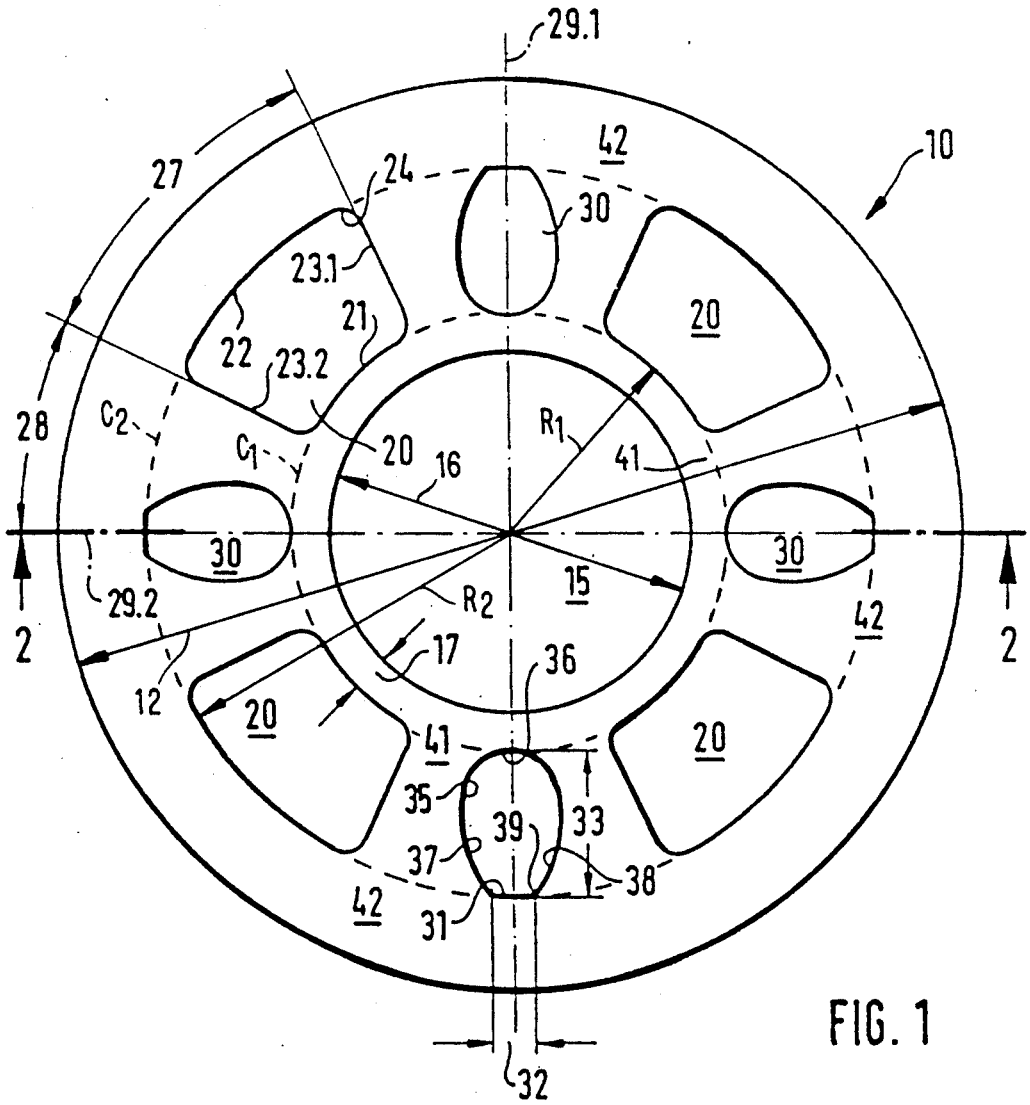
FIG. 1 is a top view of a perforated connecting disk for scaffolding constructed in accordance with the present invention.

Referring now to the drawing wherein like reference numerals are used in both views to designate like parts and, more particularly, to FIG. 1, according to this figure, a perforated connecting disk generally designated by the reference numeral 10 for a scaffolding arrangement includes an outer cylindrically delimited edge 11, with the perforated connecting disk 10 having a diameter 12 which may, for example, be about 124 mm. The perforated connecting disk 10 also has a thickness 14 (FIG. 2) which is advantageously about 10 mm. A central bore 15 is provided having a diameter 16 which, advantageously, is about 48.8 mm and exactly fits matching pipes which are generally used for upright elements and bracing elements as well as other scaffolding elements. Advantageously, the perforated connecting disk 10 is made of a light metal such as, for example, an Al-Mg-Si alloy and can advantageously be punched out of suitable panels. The perforated connecting disk 10 is slipped onto the matching pipes or tubes of the scaffolding in a suitable manner and fastened in a conventional manner by, for example, welding or the like. However, other fastening techniques may be utilized such as, for example, shrinking, crimping, gluing, deforming, or other fastening methods.

In the illustrated embodiment, the perforated connecting disk 10 includes two different types of wedge holes 20, 30, with the wedge holes 20, larger than the wedge holes 30, being disposed opposite one another along diagonals of the perforated connecting disk 10. The wedge holes 20 are delimited by two partially circular hole walls 21, 22 respectively lying on segments of inner and outer limiting circles $C_1$, $C_2$ of radii $R_1$, $R_2$ as well as two radial edges 23.1, 23.2 and rounded transitional corners with a corner radius 24. The inner partial circular hole wall 21 of the wedge holes 20 is disposed at a distance or spacing 17 from an inside wall 15.1 of the central bore 15 which, for example, is approximately 5.6 mm so that the inner limiting circle $C_1$ has, for example, a diameter 25 (FIG. 2) of 60 mm.

The outer partial circular hole wall 22 runs along the outer limiting or wedge contact circle $C_2$ having a diameter 26 (FIG. 2) of, for example, 100 mm, with the outer partial circular hole walls 22 forming the wedge contact surfaces of the large wedge holes 20. By virtue of the configuration of the outer partial circular hole walls 22 it is possible for wedges to be accommodated in the wedge holes 20 at angles which are not absolutely compulsorily determined such as, for example, at 45° to the remaining connections for diagonal rods but, in case of assemblies and additional elements, the wedges may be accommodated at obtuse angles and other angles as well.

The large wedge holes 20 have previously be used in the same shape. The hole walls 22 of the respective large wedge holes 20 each have an angular range 27 of about 40°, with the hole walls 23.1 and 23.2 respective subtending with respect to main axes 29.1, 29.2 an angle 28 of about 25°, so that the large wedge holes 20 run symmetrically along diagonals of the perforated connecting disk 10.

The small wedge holes 30 in accordance with the present invention have a special shape wherein an outer wedge contact surface 31 is formed as a tangent or chord to the limiting or wedge contact circle $C_2$ with the differences between the chord or tangent being insignificant by virtue of the shortness of the distance. The contact surface 31 of the respective wedge holes 30 has a width 32 which, in the illustrated embodiment, is approximately 6 mm to 6.5 mm but, in any case, as wide as a thickness of conventional wedges plus an amount of play for assembly and adjustment which is about 0.5 to 1 mm. Each of the wedge holes 30 have a radial depth corresponding to a radial depth of the large wedge holes 20 but the shape of the boundary is of a special type. More particularly, while conventional wedge holes used for centering were made with slightly convex, slightly radial longitudinally extending walls and an inner contour tangential or formed of a chord and bent at sharp angles, the entire hole limit 35 or contour in accordance with the present invention has the shape of a continuous curve which is symmetrical to a radius that passes through the centers of the wedge contact surfaces 31 and forms the two main axes 29.1, 29.2. The result is a substantially pear-shaped configuration, with a longitudinal axis thereof extending along the main axis 29.1 or 29.2. The opening includes, a nearly cylindrical area 36 of a smaller diameter, and two longer radii wall areas 37, 38 which are continuously joined, and which are generally of the same shape. The two side walls 37, 38 respectively make the transition at corners 39 to the wedge contact surface 31 with a relatively sharp edge at an obtuse angle. By virtue of, the fact that this area is greater distance from the than the inner areas, there is a sufficient accumulation of material in the areas 42 of the perforated connecting disk 10 which are solid and, consequently, are capable of stretching or expanding away from one another in a wedge fashion so that the inner stresses at this point will be low even at high stress forces. However, in the areas 41 closer to the center of the perforated connecting disk 10, there is less material available so that any peak stresses that may develop with conventional hole shapes have a much more critical effect on the stress pattern and hence on the loads to which the material was subjected. Such disadvantageous peak effects are completely avoided by the continuous shape of the opening in the areas 41 and pear-shaped configuration of the opening which enables the accumulation of a sufficient amount of material in the areas 42 so as to avoid any peak stresses.

The perforated connecting disk 10 in accordance with the present invention makes it possible to direct much greater wedge support forces into the wedge contact surfaces 31 which are accepted without the risk of breakage at critical points so that the scaffolding, even when made of a light metal, can handle higher loads without the risk of inadmissible deformation or breaking.

While I have shown and described only one embodiment in accordance with the present invention, it is understood that the same is not limited thereto but is susceptible to numerous changes and modifications as known to one of ordinary skill in the art, and I therefore do not wish to be limited to the details shown and described herein, but intend to cover all such modifications as are encompassed by the scope of the appended claims.

I claim:

1. A perforated disk for accommodating connecting devices for scaffolding elements comprising a plurality of first hole means for accommodating fastening wedges, and a plurality of second hole means smaller than said first hole means for accommodating fastening wedges, said plurality of second hole means each including a substantially flat wedge contact surface provided at an outer circumference thereof and adapted to be disposed in a vertical direction in an installation position of the perforated disk, wherein a contour of each of the plurality of small hole means, with the exception of the wedge contact surface, is formed as a continuous curve symmetrical with respect to a radius passing through a mid point of the wedge contact surface.

2. A perforated disk according to claim 1, wherein said contact surface has a circumferential width wider than a thickness of the wedge only by an amount of play required for installation.

3. A perforated disk according to claim 2, wherein each of said plurality of second hole means has a substantially oval shape markedly tapering at one end.

4. A perforated disk according to claim 2, wherein each of said small hole means has an inner area opposite said contact surface of a substantially cylindrical cross section and continuous transition areas on respective sides of said inner area to side areas extending from said inner area to respective ends of the contact surface.

5. A perforated disk according to claim 4, wherein said side areas are each of a larger radius than a radius of the cylindrical cross-sectional inner area.

6. A perforated disk according to claim 1, wherein each of the plurality of small hole means has an approximately pear-shape, with an inner area which is substantially cylindrical and adjacent a center of the perforated disk, said area making a continuous transition to side areas with larger radii.

7. A perforated disk according to claim 6, wherein the perforated disk is adapted to be fastened on vertical scaffolding elements including upright elements, bracing elements, intermediate parts, and special parts.

8. A perforated disk according to claim 7, wherein the wedges include wedge-shaped tapering connecting heads with push-through wedges.

* * * * *